US008143322B2

(12) United States Patent
Kwon et al.

(10) Patent No.: US 8,143,322 B2
(45) Date of Patent: Mar. 27, 2012

(54) PUMP AND PUMPING SYSTEM FOR MICROFLUIDIC LAB-ON-A-CHIP USING POROUS STRUCTURE AND FABRICATING METHOD THEREOF

(75) Inventors: Tai-Hun Kwon, Pohang-si (KR); Dong-Sung Kim, Seoul (KR); Kyoung-Je Cha, Daegu (KR)

(73) Assignees: Postech Academy-Industry Foundation, Nam-Ku, Kyungsangbuk-Do, Pohang (KR); Chung-Ang University Industry Academic Cooperation Foundation, Heukseok-Dong, Dongjak-Gu, Seoul (KR)

( * ) Notice: Subject to any disclaimer, the term of this patent is extended or adjusted under 35 U.S.C. 154(b) by 250 days.

(21) Appl. No.: 12/417,826

(22) Filed: Apr. 3, 2009

(65) Prior Publication Data

US 2009/0252629 A1 Oct. 8, 2009

Related U.S. Application Data

(60) Provisional application No. 61/042,337, filed on Apr. 4, 2008.

(51) Int. Cl.
*C08J 9/26* (2006.01)

(52) U.S. Cl. ..... 521/154; 521/61; 521/63; 521/84.1; 521/92; 528/24

(58) Field of Classification Search ..... None
See application file for complete search history.

(56) References Cited

U.S. PATENT DOCUMENTS 6,900,055 B1 * 5/2005 Fuller et al. ..... 435/395

FOREIGN PATENT DOCUMENTS

JP 2004-352830 * 12/2004

OTHER PUBLICATIONS

Machine-generated translation of JP 2004-352830 (Dec. 2004).*

* cited by examiner

*Primary Examiner* — Marc Zimmer
(74) *Attorney, Agent, or Firm* — Lexyoume IP Group, PLLC

(57) ABSTRACT

The present invention relates to a pump and pumping system for a microfluidic lab-on-a-chip, and a fabricating method thereof. An exemplary embodiment of the present invention provides a method of fabricating a pump for microfluidic lab-on-a-chips, the method including: infiltrating PDMS (polydimethylsiloxane) solution into a porous lump of water-soluble material; performing soft baking of the porous lump of water-soluble material containing the PDMS solution; and dissolving the porous lump of water-soluble material via water to obtain a porous PDMS structure.

9 Claims, 6 Drawing Sheets

(a)

(b)

(c)

PUMP AND PUMPING SYSTEM FOR MICROFLUIDIC LAB-ON-A-CHIP USING POROUS STRUCTURE AND FABRICATING METHOD THEREOF

CROSS-REFERENCE TO RELATED APPLICATION

This application claims priority to and the benefit of U.S. Provisional Application Ser. No. 61/042,337 filed on Apr. 4, 2008 and titled Development of portable pump for microfluidic lab-on-a-chip with porous PDMS structure, the entire content of which is incorporated herein by reference.

BACKGROUND OF THE INVENTION (a) Field of the Invention

The present invention relates to a microfluidic system. More particularly, the present invention relates to a pump and pumping system for a microfluidic lab-on-a-chip and a fabricating method thereof.

(b) Description of the Related Art

Recently, microfluidic systems such as a lab-on-a-chip and micro total analysis system are being researched and developed at a good pace. A pump for flowing fluid is essential to perform an experiment and analysis using microfluidic systems.

Macro-scale pumps that are externally installed, for instance a syringe pump, are frequently utilized in a pressure driven flow in microfluidic systems, and researches on these are being industriously performed. The syringe pumps are able to control extremely small and accurate amounts of fluid at a time, however, they are generally limited in use due to their size and high cost.

In this regard, various types of micropumps that are integrated directly into the microfluidic systems have been developed. But previous micropumps that are directly coupled to the microfluidic system make the systems complex to fabricate and difficult to operate, even though they might control a micro-fluid using piezoelectricity, static electricity, thermo-pneumatics, magnetism, etc.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides a pump and a pumping system for a microfluidic lab-on-a-chip and a fabricating method thereof, in which a porous PDMS structure having micropores is fabricated using leaching techniques, and is employed as a pressure transmitting device of the microfluidic lab-on-a-chip.

An exemplary embodiment of the present invention provides a method of fabricating a pump for microfluidic lab-on-a-chips, the method including: infiltrating a PDMS (polydimethylsiloxane) solution into a porous lump of water-soluble material; performing soft baking of the porous lump of water-soluble material containing the PDMS solution; and dissolving the porous lump of water-soluble material via water to obtain a porous PDMS structure.

The method may further include coating outer surfaces of the porous PDMS structure with the PDMS solution, performing soft baking of the porous PDMS structure, and forming an outlet on one of the outer surfaces of the porous PDMS structure.

The method may further include forming a hole on a surface opposing the surface where the outlet is formed.

Infiltrating the PDMS solution into the porous lump of water-soluble material may include contacting the PDMS solution with the porous lump of water-soluble material, and then maintaining the porous lump of water-soluble material in a vacuum chamber for a predetermined time.

Infiltrating the PDMS solution into the porous lump of water-soluble material may include infiltrating a solution in which a PDMS prepolymer is mixed with an initiator at a ratio of 8:1 to 15:1 by weight into the porous lump of water-soluble material.

Infiltrating the PDMS solution into the porous lump of water-soluble material may include piling up two porous lumps of water-soluble material, and then having the PDMS solution absorbed upward due to capillary force.

The porous lump of water-soluble material may be a lump of sugar or a lump of salt.

Another exemplary embodiment of the present invention provides a pumping system including a porous PDMS pump fabricated by the method described above, the porous PDMS pump being attached to a microfluidic lab-on-a-chip such that the outlet of the porous PDMS pump may communicate with an inlet of the microfluidic lab-on-a-chip.

With the method of fabricating a porous PDMS structure for a pump by a leaching technique, porosities of PDMS structures may be controlled according to shapes and sizes of leached material, and the PDMS structure itself may have varied shapes and sizes.

Accordingly, the pump can be fabricated as a portable one with varied shapes and sizes for a microfluidic lab-on-a-chip, and it is possible to fabricate a pump that is able to transmit pressure regardless of the size of the inlet of the microfluidic lab-on-a-chip.

Further, economical advantages can be expected since no special equipment is needed compared with a conventional pump.

DETAILED DESCRIPTION OF THE EMBODIMENTS

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Figure 1:
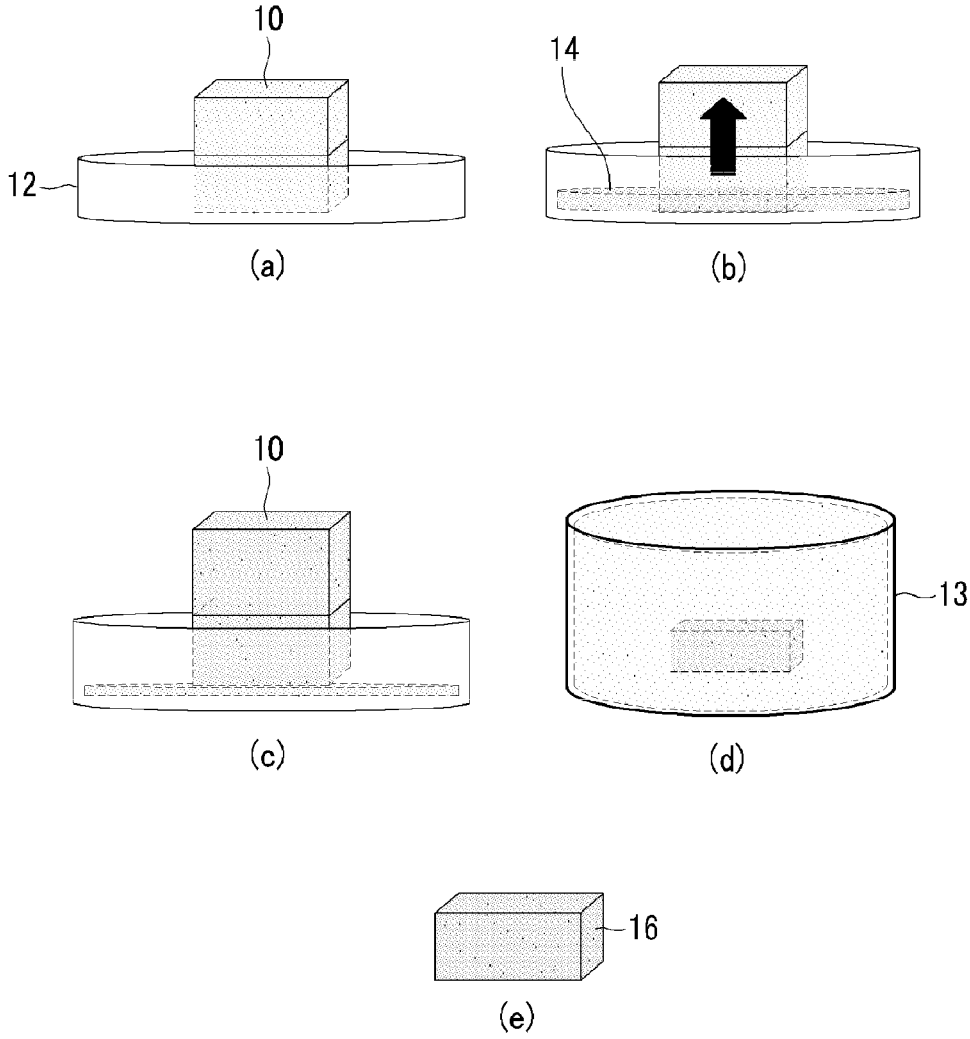
FIG. 1 schematically shows a process diagram illustrating a method of fabricating a porous structure used as a pump for a microfluidic lab-on-a-chip according to an exemplary embodiment of the present invention.

FIG. 1 schematically shows a process diagram illustrating a method of fabricating a porous structure used as a pump for a microfluidic lab-on-a-chip according to an exemplary embodiment of the present invention.

First, porous lumps of water-soluble material 10, for example, lumps of sugar or lumps of salt that are rectangular parallelepiped in shape, are prepared and provided in a container 12 such as a petri dish having a flat bottom surface. Two porous lumps 10 may be prepared and be stacked in two layers in the container 12 (referring to (a) of FIG. 1).

Then, a PDMS (polydimethylsiloxane) solution 14 is allowed to be absorbed into the porous lumps 10 by pouring the PDMS solution 14 into the container 12 where the porous lumps 10 are stacked. The PDMS solution 14 may be a mixture of a PDMS prepolymer and an initiator at an 8:1 to 15:1 weight ratio, and more preferably a 10:1 weight ratio (referring to (b) of FIG. 1).

Next, the container 12 including the porous lumps 10 and the PDMS solution 14 is placed inside a vacuum chamber (not shown). When placed in the vacuum chamber for a period of time, bubbles contained inside the PDMS solution may be removed, and then the PDMS solution infiltrates into the void space inside the porous lumps 10 by capillary force (referring to (c) of FIG. 1).

The porous lumps 10 filled with the PDMS solution 14 are taken out of the vacuum chamber, and then undergo a soft baking process. Afterward, the porous lumps 10 are dissolved via water in a water tank 13, and finally the porous PDMS structure 16 can be obtained (referring to (d) and (e) of FIG. 1).

Figure 2:
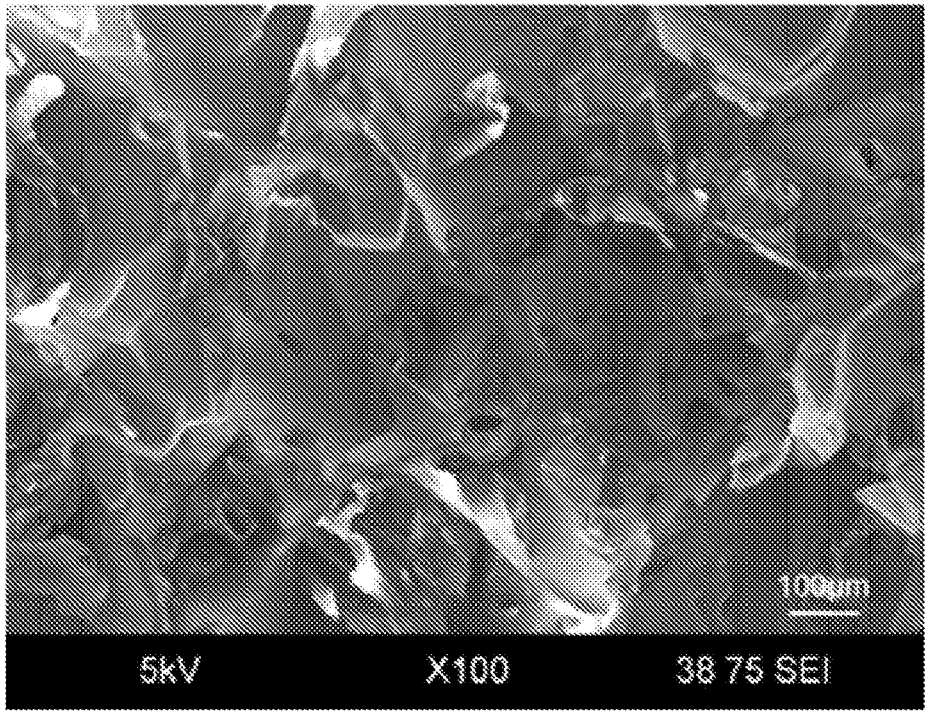
FIG. 2 is a SEM image showing a cross-section of a porous PDMS structure used as a pump for a microfluidic lab-on-a-chip according to the exemplary embodiment of the present invention.

FIG. 2 is a SEM image showing a cross-section of a porous PDMS structure used as a pump for a microfluidic lab-on-a-chip according to the exemplary embodiment of the present invention.

Referring to FIG. 2, many micropores of which the sizes correspond to the particle sizes of the porous lump of water-soluble material can be observed to be distributed arbitrarily inside the porous PDMS structure fabricated through the process shown in FIG. 1. The micropores may provide space for storing fluid when the PDMS structure is used as a pump.

Figure 3:
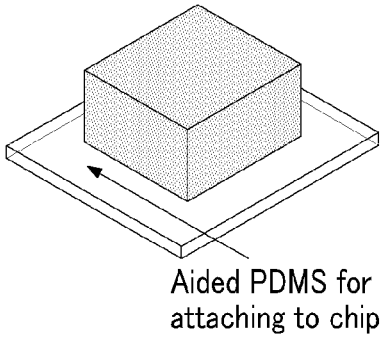
FIG. 3 shows images of (a) a coated porous PDMS structure, (b) a microfluidic lab-on-a-chip, and (c) an experimental set up for a pumping system of the microfluidic lab-on-a-chip according to the exemplary embodiment of the present invention.
Figure 3:
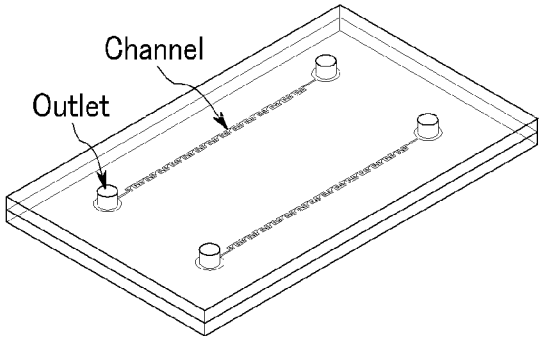
Figure 3:
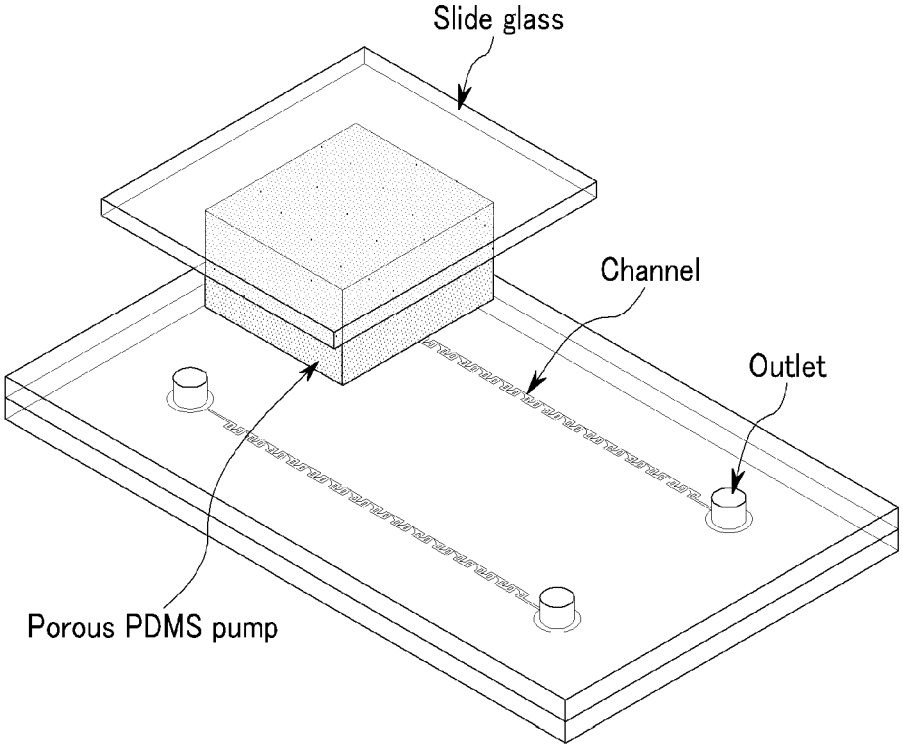

FIG. 3 shows images of (a) a coated porous PDMS structure, (b) a microfluidic lab-on-a-chip, and (c) an experimental set up for a pumping system of the microfluidic lab-on-a-chip according to the exemplary embodiment of the present invention.

It is necessary to allow fluid to enter and leave through a side surface of the fabricated porous PDMS structure in order to be employed as a pump for a microfluidic lab-on-a-chip.

Accordingly, all the surfaces of the porous PDMS structure are thinly coated with the PDMS solution, and then it undergoes a soft baking process. Afterward, an outlet is introduced on a surface of the coated porous PDMS structure, while the outlet is adjusted to an inlet of the microfluidic lab-on-a-chip in their sizes and shapes.

A pumping system as shown in (c) of FIG. 3 is completed by fixing the fabricated porous PDMS pump on the microfluidic lab-on-a-chip prepared as shown in (b) of FIG. 3. In order to address a problem that fluid flows back when the pressure is released from the porous PDMS pump, a hole may be formed on the top surface of the porous PDMS pump such that air can flow in therethrough.

Figure 4A:
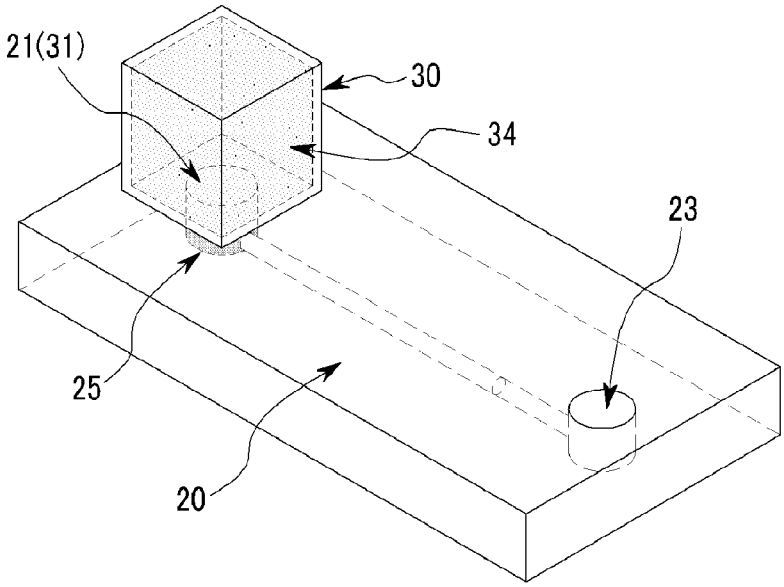
FIGS. 4A and 4B are schematic diagrams illustrating an operation process of the microfluidic lab-on-a-chip according to the exemplary embodiment of the present invention.
Figure 4B:
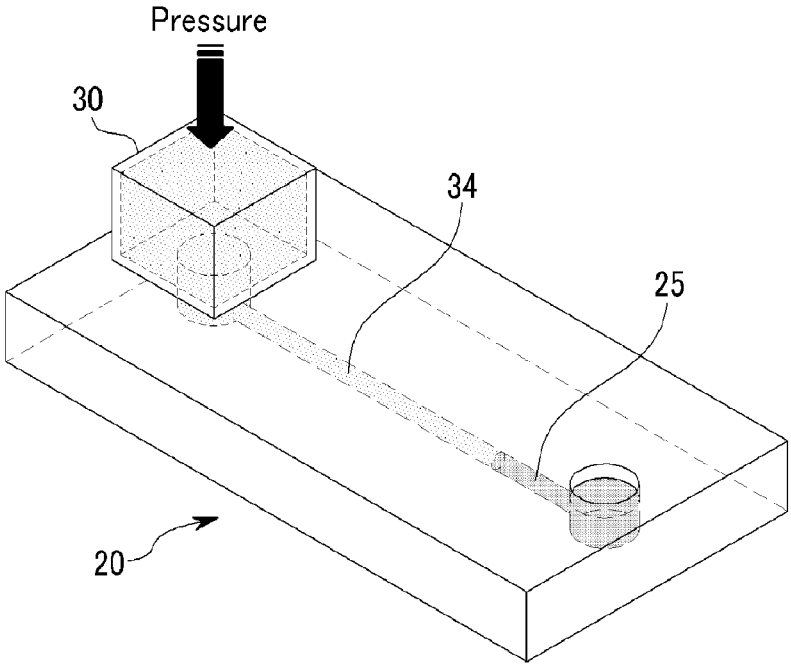

FIGS. 4A and 4B are schematic diagrams illustrating an operation process of the microfluidic lab-on-a-chip according to the exemplary embodiment of the present invention.

In order to drive a flow inside the microfluidic lab-on-a-chip 20 by pressure, a device for applying pressure at the inlet 21 or inhaling at the outlet 23 is needed. As shown in FIG. 4A, the porous PDMS pump 30 filled with saline as a working fluid is fixed on the microfluidic lab-on-a-chip while adjusting the outlet 31 of the porous PDMS pump 30 to the inlet 21 of the lab-on-a-chip. The porous PDMS pump 30 can be fixed after treating the area for fixing with oxygen plasma for about 30 seconds to 1 minute. Alternatively, adhesive agents or adhesive tapes that are non-noxious to human beings may be employed.

As shown in FIG. 4B, saline 34 pushes a sample fluid 25 in the inlet 21 of the microfluidic lab-on-a-chip 20 as the porous PDMS pump 30 is slowly pressed, which may drive a fluid flow.

EXPERIMENTAL EXAMPLE

An experiment was performed with a porous PDMS structure fixed on a lab-on-a-chip, the porous PDMS structure being fabricated according to the process as shown in FIG. 1.

First, two lumps of sugar (size of each lump: 1.5×1.5×1 $cm^3$) bought from the market were stacked in a petri dish, and then a PDMS solution, which was a mixture of PDMS prepolymer and an initiator mixed at a 10:1 weight ratio, was poured into the petri dish. The petri dish containing the lumps of sugar and the PDMS solution was placed in a vacuum chamber to remove bubbles included in the PDMS solution and maintained for about 2 hours. The lumps of sugar filled with the PDMS solution were taken out of the vacuum chamber, and then underwent a soft baking process. Afterward, the upper lump of sugar was dissolved via a large amount of water, and finally the porous PDMS structure was obtained.

Next, all the surfaces of the porous PDMS structure were coated with the PDMS solution thinly, and it then underwent a soft baking process. Afterward, an outlet was introduced on a surface of the coated porous PDMS structure, while the outlet was adjusted to an inlet of the microfluidic lab-on-a-chip in their sizes and shapes, thereby completing the porous PDMS pump. A hole was formed on the top surface of the porous PDMS pump such that fluid inside the microfluidic lab-on-a-chip would not flow back.

The completed porous PDMS pump was pressed and released within a saline solution such that the saline was absorbed into the porous PDMS pump through the outlet of the porous PDMS pump. Then, an inlet reservoir of the microfluidic lab-on-a-chip was filled with an ink as a sample fluid. Afterward, the porous PDMS pump was fixed on the microfluidic lab-on-a-chip while adjusting the outlet of the porous PDMS pump to the inlet of the lab-on-a-chip.

Figure 5:
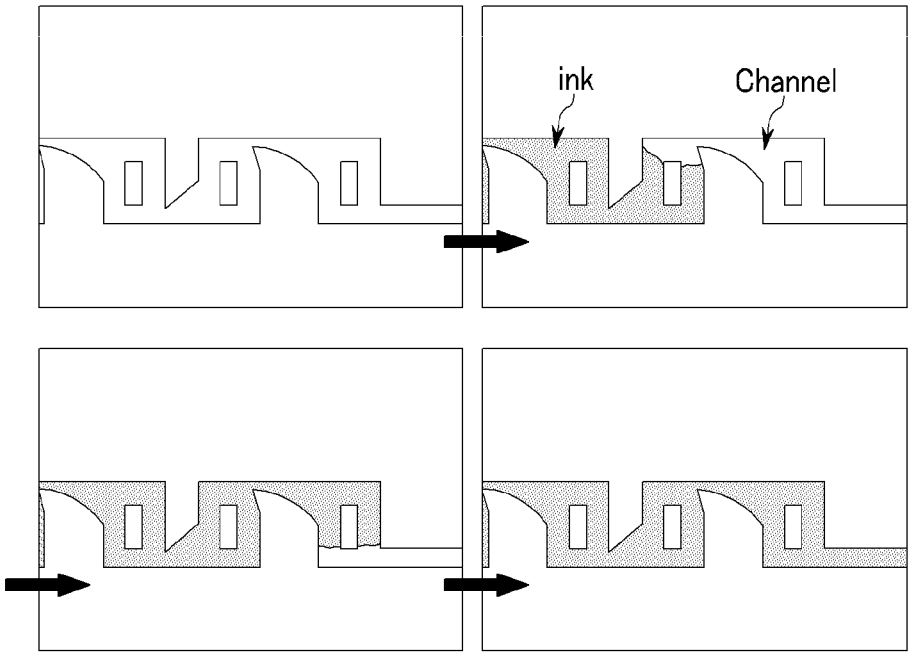
FIG. 5 shows experimental results of the microfluidic lab-on-a-chip according to the exemplary embodiment of the present invention.

By slowly pressing the top surface of the PDMS pump with a slide glass, the saline stored in the porous PDMS pump pushed the ink stored in the inlet reservoir, such that the ink flowed through channels of the microfluidic lab-on-a-chip. FIG. 5 shows flow of the ink through the channels of the microfluidic lab-on-a-chip as performed by this experiment.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method of fabricating a pump for microfluidic lab-on-a-chips, the method comprising:

infiltrating PDMS (Polydimethylsiloxane) solution into a porous lump of water-soluble material, wherein infiltrating the PDMS solution into the porous lump of water-soluble material comprises infiltrating a solution in which a PDMS prepolymer is mixed with an initiator;

performing soft baking of the porous lump of water-soluble material containing the PDMS solution; and dissolving the porous lump of water-soluble material via water to obtain a porous PDMS structure.

2. The method of claim 1, further comprising:

coating outer surfaces of the porous PDMS structure with the PDMS solution;

performing soft baking of the porous PDMS structure; and forming an outlet on one of the outer surfaces of the porous PDMS structure.

3. The method of claim 2, further comprising forming a hole on a surface opposing the surface where the outlet is formed.

4. The method of claim 1, wherein the PDMS prepolymer is mixed with the initiator at ratio of 8 to 15:1 by weight into the porous lump of water-soluble material.

5. The method of claim 1, wherein infiltrating the PDMS solution into the porous lump of water-soluble material comprises piling up two porous lumps of water-soluble material, and then having the PDMS solution absorbed upward due to capillary force.

6. The method of claim 1, wherein the porous lump of water-soluble material is a lump of sugar or a lump of salt.

7. A porous PDMS pump fabricated by the method according to claim 1, wherein the PDMS prepolymer is mixed with the initiator at ratio of 8 to 15:1 by weight into the porous lump of water-soluble material.

8. A pumping system comprises a porous PDMS pump fabricated by the method according to claim 1, the porous PDMS pump being attached to a microfluidic lab-on-a-chip such that the outlet of the porous PDMS pump may communicate with an inlet of the microfluidic lab-on-a-chip.

9. The method of claim 1, wherein infiltrating the PDMS solution into the porous lump of water-soluble material comprises contacting the PDMS solution with the porous lump of water-soluble material, and then maintaining the lump of sugar in a vacuum chamber for a predetermined time.

* * * * *